US008768185B2

(12) United States Patent
Watanabe et al.

(10) Patent No.: US 8,768,185 B2
(45) Date of Patent: Jul. 1, 2014

(54) IMAGE FORMATION DEVICE

(75) Inventors: Yasuji Watanabe, Toyokawa (JP); Atsushi Kawai, Toyokawa (JP)

(73) Assignee: Konica Minolta Business Technoliges, Inc., Chiyoda-Ku, Tokyo (JP)

( * ) Notice: Subject to any disclaimer, the term of this patent is extended or adjusted under 35 U.S.C. 154(b) by 309 days.

(21) Appl. No.: 13/398,454

(22) Filed: Feb. 16, 2012

(65) Prior Publication Data

US 2012/0213534 A1 Aug. 23, 2012

(30) Foreign Application Priority Data

Feb. 18, 2011 (JP) ..... 2011-033070

(51) Int. Cl.
*G03G 15/00* (2006.01)

(52) U.S. Cl.
USPC ..... 399/27; 399/10; 399/24

(58) Field of Classification Search
USPC ..... 399/8, 9, 10, 12, 24, 27
See application file for complete search history.

(56) References Cited

U.S. PATENT DOCUMENTS

| | | | | |
|---|---|---|---|---|
| 6,181,885 | B1 | 1/2001 | Best et al. | |
| 6,459,861 | B1 * | 10/2002 | Sakurai et al. | 399/27 |
| 2003/0161643 | A1 | 8/2003 | Uyama et al. | |
| 2008/0317478 | A1 | 12/2008 | Suda | |

FOREIGN PATENT DOCUMENTS

| | | |
|---|---|---|
| EP | 1 338 928 | 2/2003 |
| EP | 1 598 767 | 5/2005 |
| JP | 2000-127598 | 5/2000 |
| JP | 2004-358719 | 12/2004 |
| JP | 2005-116028 | 4/2005 |
| JP | 2007-111915 | 5/2007 |
| JP | 2008-83150 | 4/2008 |
| JP | 2010-177737 | 8/2010 |

OTHER PUBLICATIONS

Extended Search Report dated May 3, 2012, directed to European Application No. 12154182.5; 6 pages.

First Office Action dated Jul. 9, 2013, directed to Chinese Application No. 201210037820.9; 12 pages.

* cited by examiner

*Primary Examiner* — David Gray
*Assistant Examiner* — Michael Harrison
(74) *Attorney, Agent, or Firm* — Buchanan Ingersoll & Rooney PC

(57) ABSTRACT

An image formation device for use with a consumable removably loaded therein, the consumable including a non-volatile consumable memory, the image formation device including: a non-volatile device memory; an abnormality detection unit detecting an abnormality pertaining to the consumable; a detection registration unit registering abnormality detection data into both memories when the abnormality pertains to the consumable and no relevant abnormality data are registered in either memory, the abnormality detection data representing the detected abnormality; a confirmation registration unit registering abnormality confirmation data after the consumable has been exchanged and new abnormality detection data pertaining to a new abnormality detected by the abnormality detection unit are registered in only one of the memories, the abnormality confirmation data replacing the new abnormality detection data in the appropriate memory; and a confirmation notification unit making a notification of abnormality confirmation when the abnormality confirmation data are registered by the confirmation registration unit.

10 Claims, 8 Drawing Sheets

FIG. 7A Update table A

| | | Main body | | |
|---|---|---|---|---|
| | | No detection | Detection | Confirmation |
| Imaging unit | No detection | Main body → Detection<br>IU → Detection | Main body → Confirmation<br>IU → No detection | Main body → Confirmation<br>IU → No detection |
| | Detection | Main body → No detection<br>IU → Confirmation | Main body → Detection<br>IU → Detection | Main body → Confirmation<br>IU → Detection |
| | Confirmation | Main body → No detection<br>IU → Confirmation | Main body → Detection<br>IU → Confirmation | Main body → Confirmation<br>IU → Confirmation |

FIG. 7B Update table B

| | | Main body | | |
|---|---|---|---|---|
| | | No detection | Detection | Confirmation |
| Imaging unit | No detection | Main body → No detection<br>IU → No detection | Main body → Detection<br>IU → No detection | Main body → Detection<br>IU → No detection |
| | Detection | Main body → No detection<br>IU → Detection | Main body → Detection<br>IU → Detection | Main body → Detection<br>IU → Detection |
| | Confirmation | Main body → No detection<br>IU → Detection | Main body → Detection<br>IU → Detection | Main body → Detection<br>IU → Detection |

IMAGE FORMATION DEVICE

CROSS-REFERENCE TO RELATED APPLICATIONS

This application is based on application No. 2011-033070 filed in Japan, the contents of which are hereby incorporated by reference.

BACKGROUND OF THE INVENTION (1) Field of the Invention

The present invention pertains to an image formation device, and particularly pertains to technology for simplifying analysis of faulty removable components.

(2) Description of the Related Art

Conventionally, in order to extend the useful life of an image formation device, a structure is employed in which consumables such as imaging units, having a shorter useful life than the main device, are fully removable and exchangeable. Thus, consumables are replaceable upon failure, as well as at the end of their useful life. Faulty consumables are typically replaced once the image formation device detects failure pertaining thereto and notifies a user to such effect. Such circumstances include cases where the user personally exchanges a toner cartridge or the like, and cases where a service person is called to perform such an exchange.

Consumable-related failure may be detected in cases where failure has occurred in the image formation device itself, and in cases where failure has occurred in the removable consumables. Consequently, a standard procedure exists for verifying the operation of the image formation device once the service person has removed consumables from the problematic image formation device and exchanged them for spares. If failure is not detected in the image formation device after exchange, the fault is deemed likely to lie in the consumables. In such a case, the spares remain in the image formation device while the removed consumables are taken to a service centre for damage analysis. On the other hand, when failure is still detected in the image formation device despite exchange, the fault is deemed likely to lie in the device. The service person therefore investigates the image formation device and analyses the source of the problem.

However, such a determination regarding whether the fault lies in the image formation device or in the consumables cannot always be performed on the basis of image formation device damage notifications alone. Some types of damage may occur sporadically. In such cases, the damage may not be immediately reproduced upon exchanging the consumables, despite the fault lying in the image formation device. Alternatively, there may be a problem with the connection status of the consumables. For example, the electrical connection of the consumables may be interrupted due to some form of failure in the image formation device leading to the consumables becoming slightly misaligned with respect to the correct loading position. In such cases, the problem is not immediately reported upon exchanging the consumables.

Furthermore, a single image formation device and the consumables thereof may not be continuously maintained and inspected by the same service person. For instance, identical failure may re-occur in an image formation device for which previous failure was deemed as likely caused by the consumables therein. Although the original service person may then conclude that the fault actually lies in the image formation device itself, a different service person may respond to the second occurrence and thus not be easily able to identify the true cause of the fault as lying in the image formation device.

Accurate identification of the cause of failure is linked to improved usability for the image formation device user. Thus, accurate determination of whether the fault lies in the consumables or in the image formation device is desired.

SUMMARY OF THE INVENTION

In order to achieve this aim, an image formation device for use with a consumable removably loaded therein is provided, the consumable including a non-volatile consumable memory, the image formation device comprising: a non-volatile device memory; an abnormality detection unit detecting an abnormality pertaining to the consumable; a detection registration unit registering abnormality detection data into the consumable memory and into the device memory when the abnormality pertains to the consumable and no relevant abnormality data are registered in either of the consumable memory and the device memory, the abnormality detection data representing the detected abnormality; a confirmation registration unit registering abnormality confirmation data after the consumable has been exchanged and new abnormality detection data pertaining to a new abnormality detected by the abnormality detection unit are registered in only one of the consumable memory and the device memory, the abnormality confirmation data replacing the new abnormality detection data in the appropriate one of the consumable memory and the device memory; and a confirmation notification unit making a notification of abnormality confirmation when the abnormality confirmation data are registered by the confirmation registration unit.

BRIEF DESCRIPTION OF THE DRAWINGS

This and other aims, advantages, and features of the invention will become apparent from the following description thereof, taken in conjunction with the accompanying drawings that illustrate a specific embodiment of the invention.

In the drawings:

FIG. 7A lists the content of determination results update table A;

FIG. 7B lists the content of determination results update table B; and

DESCRIPTION OF PREFERRED EMBODIMENTS

The following describes an image formation device serving as an Embodiment of the present invention, with reference to the accompanying drawings.

[1] Image Formation Device Configuration

The following describes the configuration of the image formation device pertaining to the present Embodiment.

Figure 1:
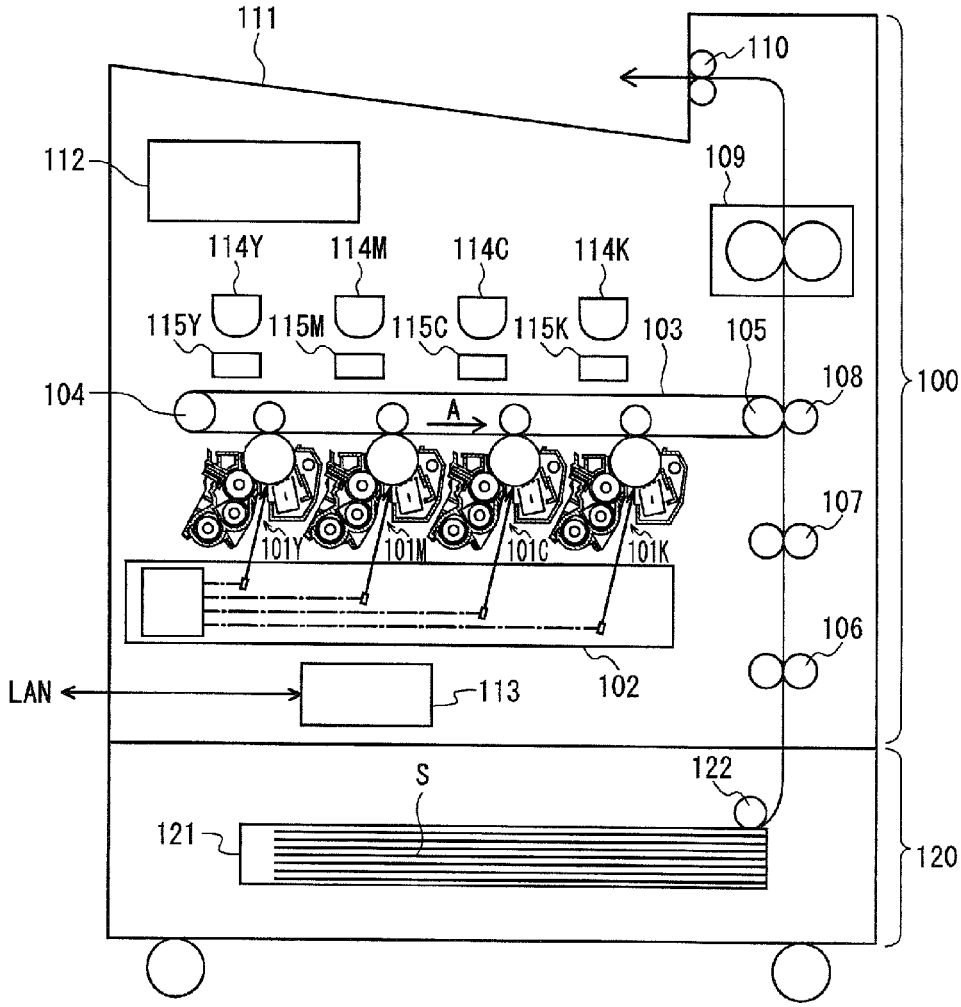
FIG. 1 shows the configuration of the image formation device pertaining to an Embodiment of the present invention.

FIG. 1 shows the configuration of the image formation device pertaining to the present invention. As shown, the image formation device 1 pertaining to the present invention is a colour printer that includes an image formation unit 100 and a feed unit 120.

The image formation unit 100 includes imaging units 101Y, 101M, 101C, and 101K, each forming a toner image in a respective colour, namely yellow (Y), magenta (M), cyan (C), or black (K). The imaging units 101Y, 101M, 101C, and 101K create a toner image in the respective colours Y, M, C, and K upon being scanned by a laser from an exposure device 102. The toner images created by the imaging units 101Y, 101M, 101C, and 101K undergo a sequential transfer (primary transfer) onto an intermediate transfer belt 103, thus being overlaid into a whole. The intermediate transfer belt 103 overspans a driving roller 104 and a driven roller 105. The drive roller 104 causes rotation, thereby causing the intermediate transfer belt 103 to transport the toner images in the direction of arrow A.

The feed unit 120 includes a feed tray 121, in which recording sheets S are loaded, and a pick-up roller 122. The feed unit 120 uses the pick-up roller 122 fed by the feed unit 120 passes through a pair of transport rollers 106, arriving at a pair of timing rollers 107. The timing rollers 107 adjust the transport timing of each recording sheet S such that the toner image is transferred to a predetermined position on the recording sheet S. The timing rollers 107 are also used in recording sheet S skew correction.

A secondary transfer roller 108 is provided with the driven roller 105 so as to form a pair of secondary transfer rollers. When a transfer voltage is applied to this pair of rollers, the toner image on the intermediate transfer belt 103 undergoes a static transfer (secondary transfer) to the recording sheet S. A fixing device 109 heats and fuses the toner image carried by the recording sheet S, thus fixing the toner image to the recording sheet S. The recording sheet S with the toner image fixed thereto is ejected by a pair of exit rollers 110 onto an exit tray 111.

The image formation unit 100 also includes a control unit 112. The control unit 112 controls and directs all operations of the image formation device 1. In addition, the control unit 112 has a communication interface device 113 that is in communication with other devices through a LAN (Local Area Network). As such, the control unit 112 receives print jobs from a PC (Personal Computer) or similar.

Each imaging unit 101Y, 101M, 101C, and 101K has a toner cartridge 114Y, 114M, 114C, or 114K supplying toner in the respective colour Y, M, C, or K through a sub-hopper 115Y, 115M, 115C, or 115K.

[2] Imaging Unit 101Y, 101M, 101C, 101K Configuration

The following describes the configuration of the imaging units 101Y, 101M, 101C, and 101K. The imaging units 101Y, 101C, 101M, and 101K all have the same configuration. As such, the colour-specifying symbols Y, M, C, and K are omitted.

Figure 2:
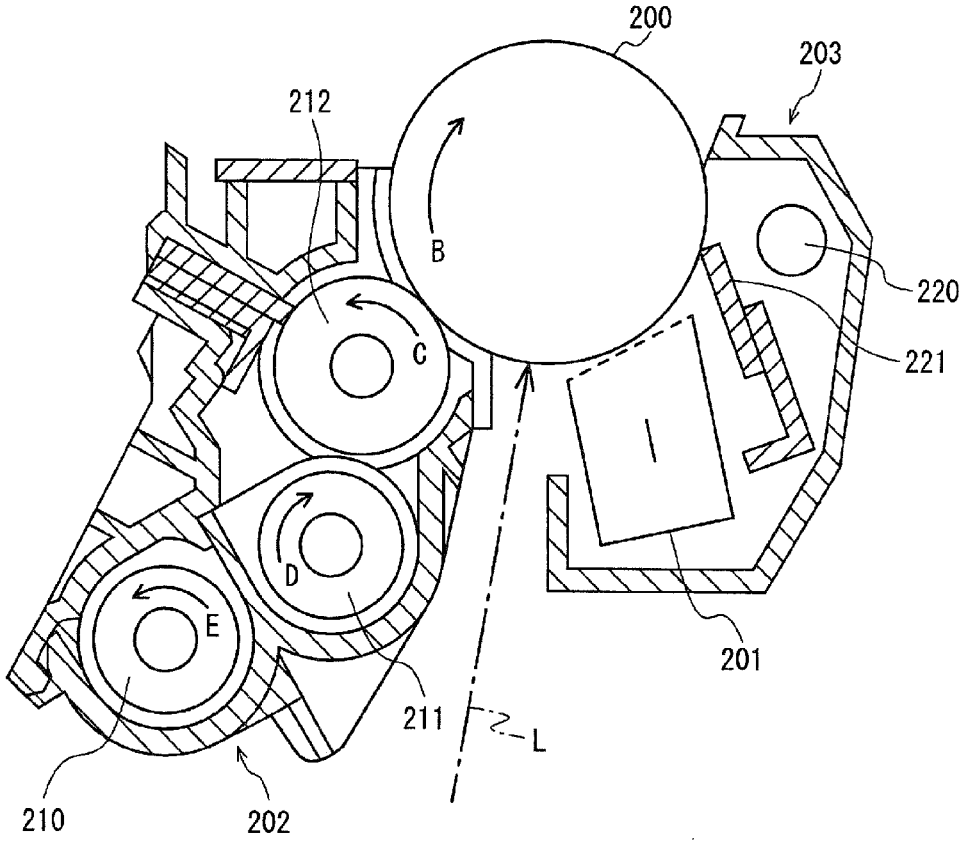
FIG. 2 is a cross-sectional diagram showing the configuration of an imaging unit 101.

FIG. 2 is a cross-sectional diagram showing the configuration of an imaging unit 101. As shown, the imaging unit 101 has a photosensitive drum 200 rotating in the direction indicated by arrow B, and includes a charging device 201, a developing device 202, and a cleaning device 203 arranged circumferentially along the rotation direction of the photosensitive drum 200. The photosensitive drum 200, the charging device 201, and the cleaning device 203 make up a drum unit, while the developing device 202 makes up a developing unit. A gap is arranged between the drum unit and the developing unit in order to allow a laser L from the exposure device 102 to reach the circumferential surface of the photosensitive drum 200.

A photosensitive layer is provided on the circumferential surface of the photosensitive drum 200. The charging device 201 uniformly charges the photosensitive layer through coronal discharge, for example. The uniformly-charged photosensitive layer forms a latent static image upon exposure to the laser L from the exposure device 102. The developing device 202 uses a pair of stirring and conveying screws 210 and 211 respectively rotating in the directions of arrows E and D to statically charge the toner by stirring and conveying a two-component developer that the includes toner and a carrier. The statically charged toner is supplied to the circumferential surface of the photosensitive drum 200 by a supply roller 212 rotating in the direction of arrow C. The latent static image is thus made visible.

Thus, as described, the toner image formed on the circumferential surface of the photosensitive drum 200 undergoes the primary transfer to the intermediate transfer belt 103. Subsequently, the cleaning device 203 removes the charge from the photosensitive layer by exposing the circumferential surface of the photosensitive drum 200 to a charge-removing lamp 220, and cleans off any remaining toner by scraping the circumferential surface of the photosensitive drum 200 with a cleaner blade 221.

Figure 3A:
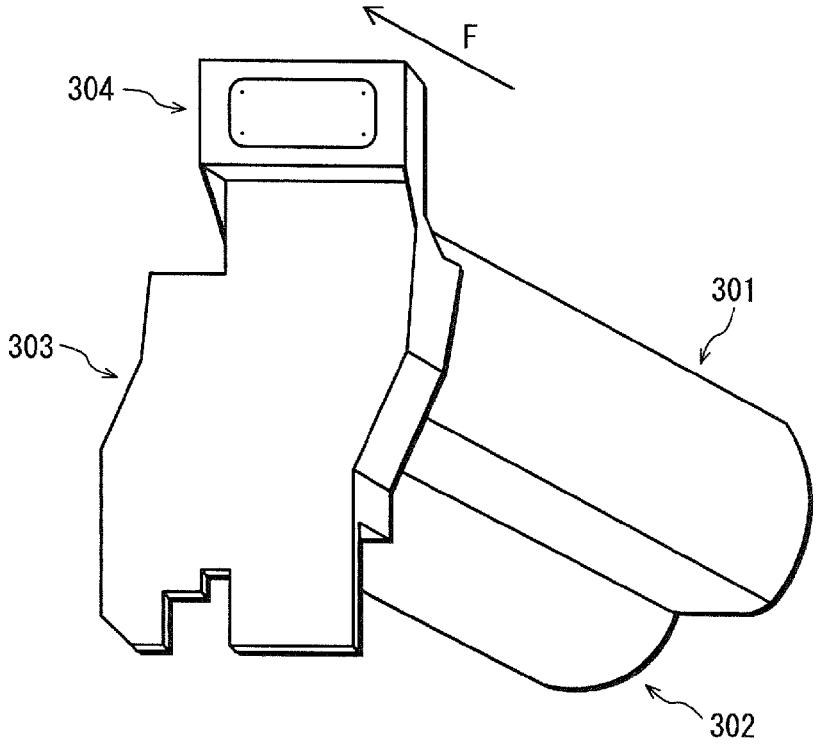
FIG. 3A is a perspective view diagram of an imaging unit 101 as seen from the front of an image formation device 1 when the doors thereof are open.
Figure 3B:
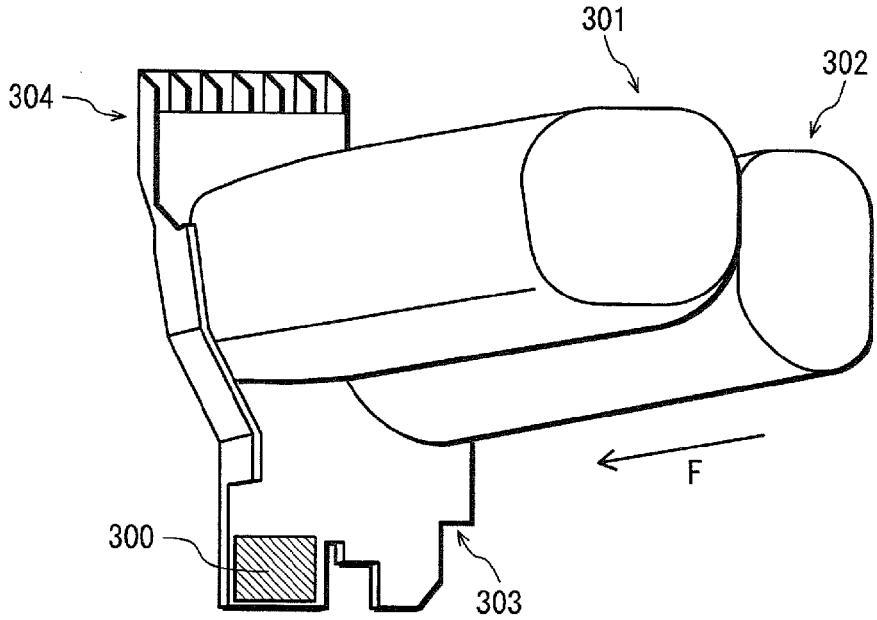
FIG. 3B is a perspective view diagram of the imaging unit 101 as seen from the back of the image formation device 1 when the doors thereof are open.

FIG. 3A is a perspective view diagram of the imaging unit 101 as seen from the front of the image formation device 1 when the doors thereof are open. FIG. 3B is a perspective view diagram of the imaging unit 101 as seen from the back of the image formation device 1 when the doors thereof are open. As shown in FIG. 3A, the imaging unit 101 includes a drum unit 301, a developing unit 302, and a unit cover 303 attached to the front thereof. A handle 304 is provided at the top of the unit cover 303, enabling the imaging unit 101 to be pulled out of the image formation device, in the direction of arrow F. The imaging unit 101 may also be loaded into the image formation device 1 by pressing the unit cover 303 toward the direction opposite arrow F.

A non-volatile memory (hereinafter, IU memory) 300 is affixed to the back of the unit cover 303. An electrical contact point is provided in the image formation device 1 at a position opposing the IU memory 300 when the imaging unit 101 is loaded. The IU memory 300 and the control unit 112 of the image formation device 1 are electrically connected by pressing an (non-diagrammed) electrode of the IU memory 300 against the electrical contact point. This enables the control unit 112 to write data to and read data from the IU memory 300.

[3] Control Unit 112 Configuration

The following describes the configuration of the control unit 112.

Figure 4:
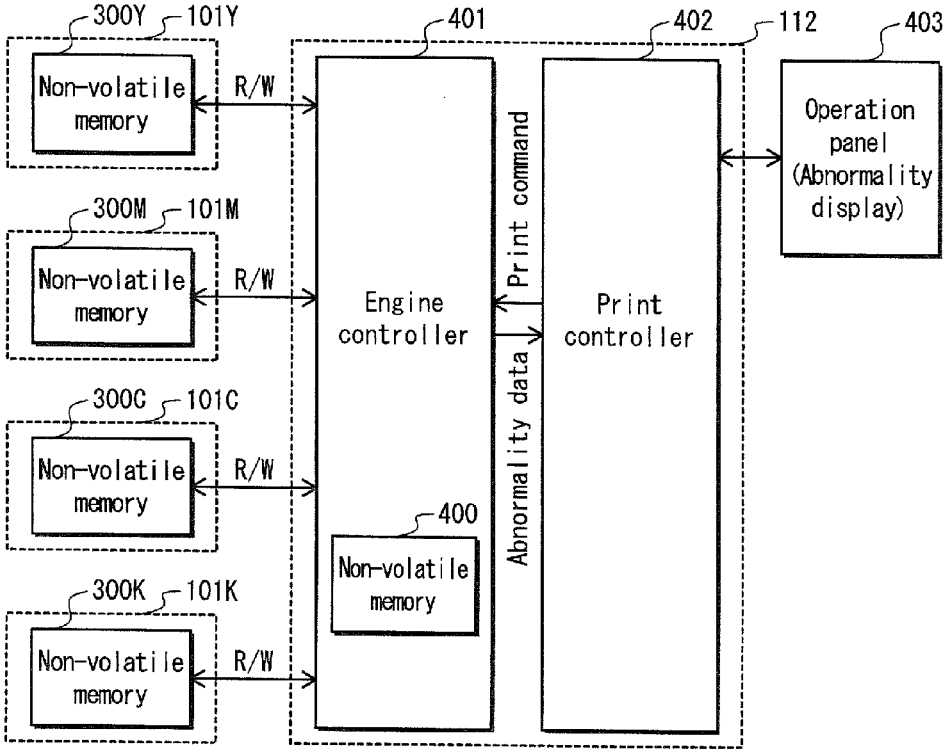
FIG. 4 is a block diagram showing the overall configuration of the control unit 112.

FIG. 4 is a block diagram showing the overall configuration of the control unit 112. As shown, the control unit 112 includes an engine controller 401 controlling the imaging units 101Y, 101C, 101M, and 101K, and a printer controller 402 directing the overall operations of the image formation device 1.

Upon receiving a print command from the printer controller 402, the engine controller 401 controls the imaging units 101Y, 101M, 101C, and 101K to create a toner image. The engine controller 401 is also able to write data to and read data from the IU memory 300Y, 300M, 300C, or 300K respectively provided to each imaging unit 101Y, 101C, 101M, and 101K. The engine controller 401 further includes a non-volatile memory (hereinafter, device memory) 400, and is able to read data from and write data to the device memory 400.

The engine controller 401 detects any abnormalities occurring in the imaging units 101Y, 101M, 101C, and 101K, then notifies the printer controller 402 of abnormality data upon detection. Upon receiving the abnormality data, the printer controller 402 displays the abnormality data on an operation panel 403, thus notifying a user of the image formation device 1 of the abnormality. The operation panel 403 also displays non-abnormality data as needed, and receives operation input from the user of the image formation device 1. Furthermore, the printer controller 402 receives print jobs from the previously-described communication interface device 113.

The engine controller 401 monitors the state of the imaging unit 101, thus detecting any abnormalities therein. For example, the engine controller 401 monitors the remaining quantity of developer in the developing device 202. When the remaining quantity is too low, the engine controller 401 controls the corresponding sub-hopper 115 to supply toner from an appropriate toner cartridge 114. When the remaining quantity is too low despite sufficient toner remaining in the appropriate toner cartridge 114 and toner supply operations being performed, the engine controller 401 determines that an abnormality has occurred in the imaging unit 101.

This circumstance has many possible causes, such as: a problem with the electrical connection between the engine controller 401 and the imaging unit 101 leading to the remaining amount being incorrectly detected as too low; a malfunction in the sub-hopper 115 leading to the remaining toner problem being unresolved; and the remaining amount of toner being incorrectly detected by the imaging unit 101. The abnormality detection process performed by the engine controller 401 does not specify the source of the abnormality, instead only recording abnormality data and making a notification.

Figure 5A:
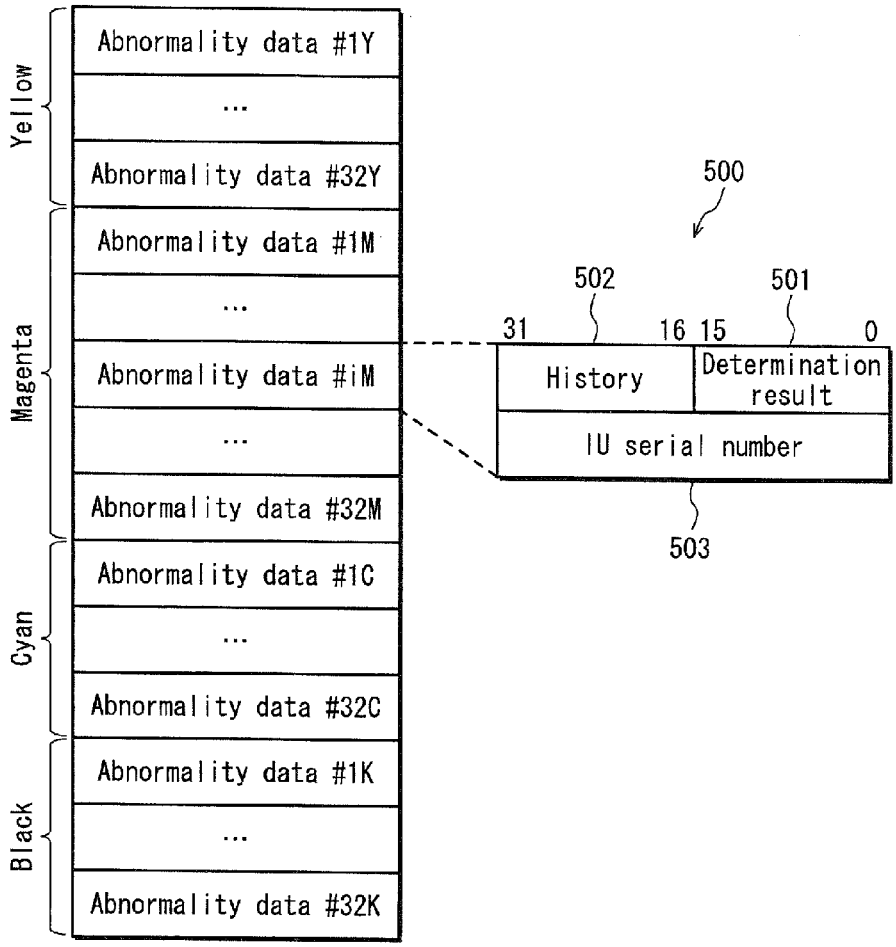
FIG. 5A shows a memory map of a device memory 400 pertaining to abnormality data.
Figure 5B:
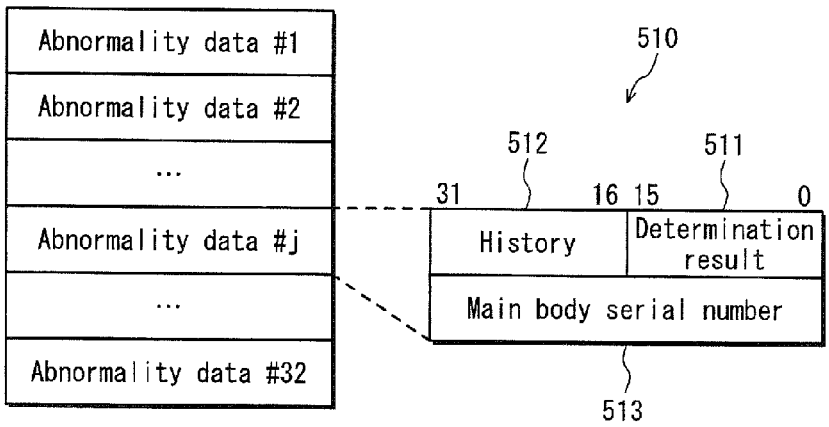
FIG. 5B shows a memory map of the IU memory 300 pertaining to the abnormality data.

FIG. 5A shows a memory map of the device memory 400 pertaining to the abnormality data. FIG. 5B shows a memory map of the IU memory 300 pertaining to the abnormality data. As shown in FIG. 5A, the device memory 400 has abnormality data fields 500 storing the abnormality data. A total of 128 12-byte abnormality data fields 500 are provided, or 32 for each of colour Y, M, C, and K.

Each abnormality data field 500 has a two-byte determination result sub-field 501, a two-byte history sub-field 502, and an eight-byte serial number area 503. The determination result sub-field 501 registers a 1 (detection) when an abnormality is detected in the imaging unit 101. When the determination result sub-field 501 has registered a 1 (detection), the abnormality data are referred to as abnormality detection data. Similarly, the determination result sub-field 501 registers a 2 (confirmation) when the cause of the abnormality in the imaging unit 101 is surmised to lie in the device. In such cases, the abnormality data are referred to as abnormality confirmation data. A 0 registered in the determination result sub-field 501 signifies that an abnormality has not yet been detected.

The history sub-field 502 initially has a value of 0 registered therein. The value is incremented once an abnormality has been registered, as described below. The count is further incremented with every subsequent consecutive attempt for which no abnormality is detected. The serial number sub-field contains a serial number for the imaging unit 101 detected as having the abnormality. A serial number ranging from #1 to #32 is assigned to each of the 32 abnormality data fields 500 and is used to specify and respond to specified abnormalities. For example, abnormality data field #1 may be used to store abnormality data pertaining to the supply of toner to the developing device 202.

As shown in FIG. 5B, the IU memory 300 likewise has 32 12-byte abnormality data fields 510. The abnormality data fields 510 are substantially similar to the abnormality data fields 500, differing only in that the IU serial number is replaced with the serial number of the image formation device.

[4] Control Unit 112 Operations

The following describes the operations of the control unit 112

Figure 6:
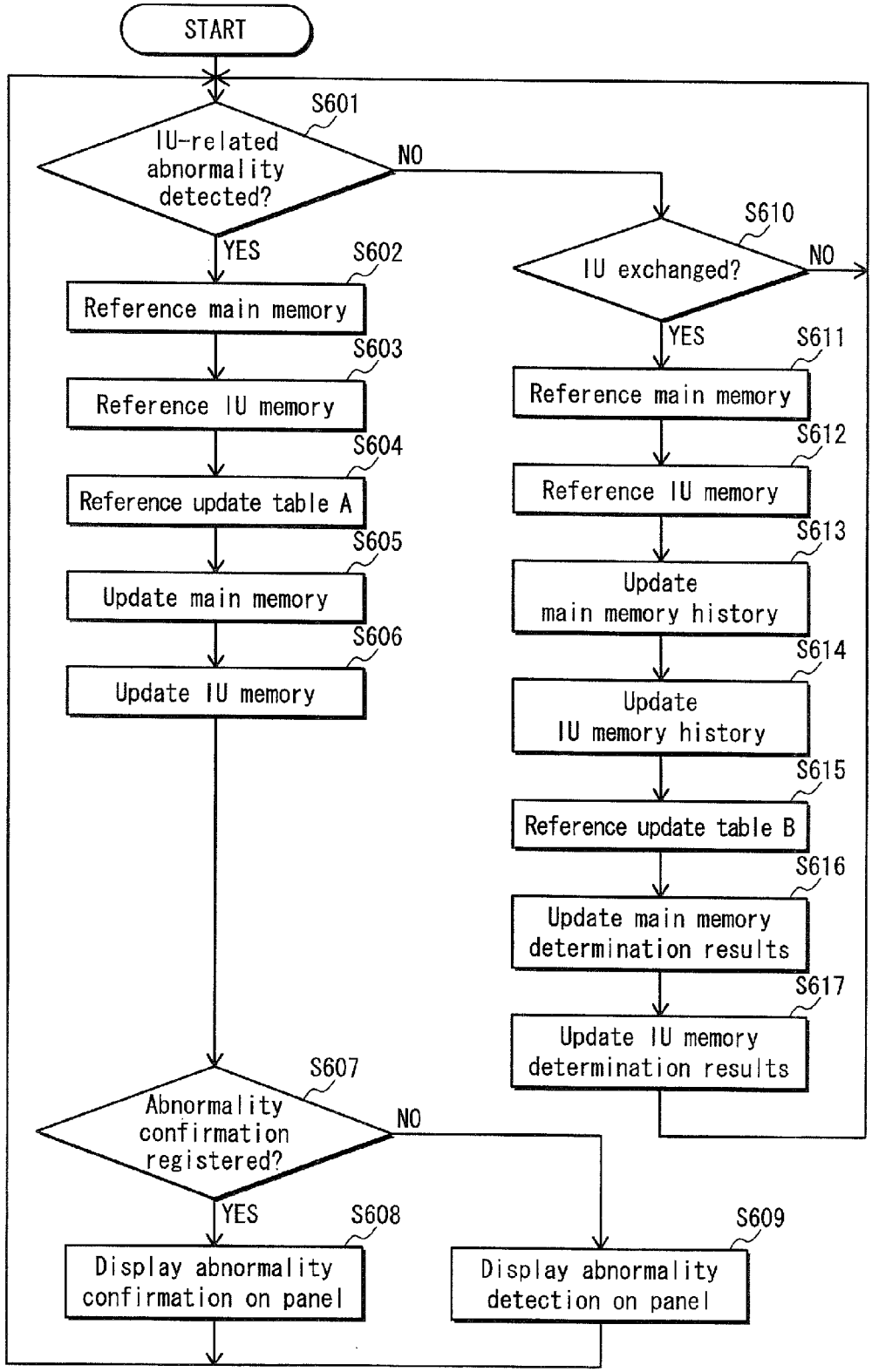
FIG. 6 is a flowchart indicating the principal operations of the control unit 112.

FIG. 6 is a flowchart indicating the principal operations of the control unit 112. As shown, upon detecting an abnormality related to any one of the imaging units 101 (YES in step S601), the control unit 112 references the abnormality data concerning the abnormality in the device memory 400 (step S602), and also references the abnormality data concerning the abnormality in the IU memory 300 of the relevant imaging unit 101 (step S603). The control unit 112 further references a determination results update table A (S604), then updates the determination result subfield 501 and the serial number subfield 503 of the device memory 400 as well as the determination result subfield 511 and the serial number subfield 513 of the IU memory 300 (steps S605, S606).

In other words, the serial number subfield of the abnormality data corresponding to the detected abnormality holds the serial number of the imaging unit 101 in the device memory 400 and holds the serial number of the image formation device 1 in the IU memory 300. Further, a value is stored in the determination result subfield. This value is determined by the current content of the determination result subfield and the determination results update table A. The serial number of the imaging unit 101 is, for example, read from the IU memory 300 of the relevant imaging unit 101.

FIG. 7A shows the content of the determination results update table A. FIG. 7B shows the content of a determination results update table B. The determination results update table A indicates the update to be applied to the determination result subfield of the abnormality data when an abnormality pertaining to the imaging unit 101 is detected. Specifically, the post-update determination results are determined by the pair of determination results recorded as the pre-update abnormality data of the device memory 400 and of the IU memory 300. The same applies to the determination results recorded in the abnormality data of the IU memory 300.

For example, when the determination result subfield of the abnormality data pertaining to a detected abnormality reads 0 (no detection) for the device memory 400 and for the IU memory 300, the device memory 400 and the IU memory 300 both register a 1 (detection) in the determination result subfield. Also, when the abnormality data pertaining to a detected abnormality read 0 (no detection) in the determination result subfield of the device memory 400 and reads 1 (detection) in the determination result subfield of the IU memory 300, the determination result subfield of the device memory 400 remains as-is, reading 0 (no detection) while the determination result subfield of the IU memory 300 registers a 2 (confirmation).

Next, when either one of the device memory 400 and the IU memory 300 has registered a 2 (confirmation) in the determination result subfield (YES in step S607), the operation panel 403 displays an abnormality confirmation (step S608). Otherwise, (NO in step S607), the operation panel 403 displays an abnormality detection (S609).

When the imaging unit 101 detects no abnormality (NO in step S601) and an exchange of imaging unit 101 has been detected (YES in step S610), the device memory 400 and the IU memory 300 are referenced (steps S611, S612) and an update is performed to increment the value registered in the history subfield of the abnormality data of the device memory 400 and of the IU memory 300 (steps S613 and S614). Then, determination results update table B is referenced (step S615). If necessary, the determination result subfield of the device memory 400 and the IU memory 300 are updated as follows (steps S616 and S617).

Determination results update table B indicates the update applied to the determination result subfield of the abnormality data when no abnormalities have been detected according to the history subfield. Specifically, the post-update determination results are determined by the pair of determination results recorded as the abnormality data of the device memory 400 and of the IU memory 300.

For example, when the determination result subfield of the abnormality data pertaining to a detected abnormality read 0 (no detection) for the device memory 400 and for the IU memory 300, the device memory 400 and the IU memory 300 both remain as-is, with a 0 (no detection) registered in the determination result subfield. Also, when the abnormality data pertaining to a detected abnormality read 0 (no detection) in the determination result subfield of the device memory 400 and reads 1 (detection) in the determination result subfield of the IU memory 300, the determination result subfield of the device memory 400 remains as-is, reading 0 (no detection) while the determination result subfield of the IU memory 300 registers a 1 (detection).

Also, when a predetermined number of consecutive detections (e.g., three detections) have been performed with no abnormalities being registered in the history subfield, and the determination result subfield of the abnormality data has registered a 1 (detection), the determination result subfield of the abnormality data is reset to 0 (no detection). After steps S608, S609, and S617, the process returns to step S601 and repeats the above.

[5] Operations Example

The following describes an example of image formation device 1 operations.

(1) Abnormality Source in Device

First, a case in which the source of the abnormality is in the image formation device is described.

When an abnormality related to one of the imaging units 101 loaded into the image formation device pertaining to the present Embodiment is detected, the device memory 400 of the image formation device 1 and the IU memory 300 of the imaging unit 101 both register a 1 (detection) in the determination result subfield of the abnormality data. Also, a service person, called once the user is notified of abnormality detection, may analyze the damage, then remove the imaging unit 101 from the image formation device 1 to load a different imaging unit 101 therein. As such, according to the present Embodiment, the determination results registered in the abnormality data of the device memory 400 remains as-is, with a 1 (detection) registered, provided that no further abnormalities are detected after this exchange of the imaging unit 101

Sporadically-occurring abnormalities may not be immediately reproduced upon exchanging the imaging unit 101. Thus, a 1 (detection) is registered in the determination result subfield of the abnormality data in the device memory 400. Should the same abnormality re-occur, a 2 (confirmation) is registered in the determination result subfield 501 of the abnormality data in the device memory 400, enabling another service person responding to the abnormality to quickly realize that the fault lies in the image formation device 1.

(2) Abnormality Source in Imaging Unit 101

The following describes a case in which the source of the abnormality is in the imaging unit 101.

A service person called upon abnormality detection may, after exchanging the imaging unit 101 loaded in the image formation device 1 with another imaging unit 101, take the original imaging unit 101 to a service center. The abnormality is not always reproduced upon loading the original imaging unit 101 in another image formation device 1 located at the service center.

According to the present Embodiment, in such cases, a 1 (detection) is registered in the determination result subfield of the abnormality data in the IU memory of the imaging unit 101 pertaining to the detected abnormality. Thus, when an abnormality is detected after the imaging unit 101 is loaded into a different image formation device 1, the determination result subfield of the abnormality data in the IU memory of the imaging unit 101 registers a 2 (confirmation). Accordingly, the imaging unit 101 is quickly identifiable as highly likely to be the source of the abnormalities, even if a different service person analyses the abnormality source.

(3) Transient Abnormality Detection

The following describes a case in which an abnormality having a transient source is detected.

According to the present invention, a 1 (detection) is registered in the determination result subfield of the abnormality data in the device memory 400 and in the IU memory 300 when a transient error is detected. Transient abnormalities may be detected as a result of user mishandling and the like, and are therefore difficult to reproduce after initial detection.

Accordingly, when, due to a different cause, an abnormality is detected after the imaging unit 101 has been exchanged, performing an update of the determination result subfield of the abnormality data according to determination results update table A leads to a 2 (confirmation) being registered, despite the abnormality in question occurring for the first time. Such a determination result is not as accurate as a case where the same abnormality is actually detected twice. Given this lack of reliability, the service person may err in determining the source of the abnormality.

In contrast, according to the present Embodiment, when the imaging unit has been exchanged after abnormality detection but no subsequent abnormality is detected, a 1 (detection) is registered in the determination result subfield instead of a 2 (confirmation), in accordance with determination results update table B. Also, when a predetermined number of detection attempts have been performed with no further abnormalities being detected, a 0 (no detection) is registered in the determination result subfield instead of a 1 (detection). This affords greater credibility to the content recorded in the determination result subfield.

[6] User Notification Examples

The following describes an example of user notifications made via the operation panel when an abnormality is detected.

Figure 8:
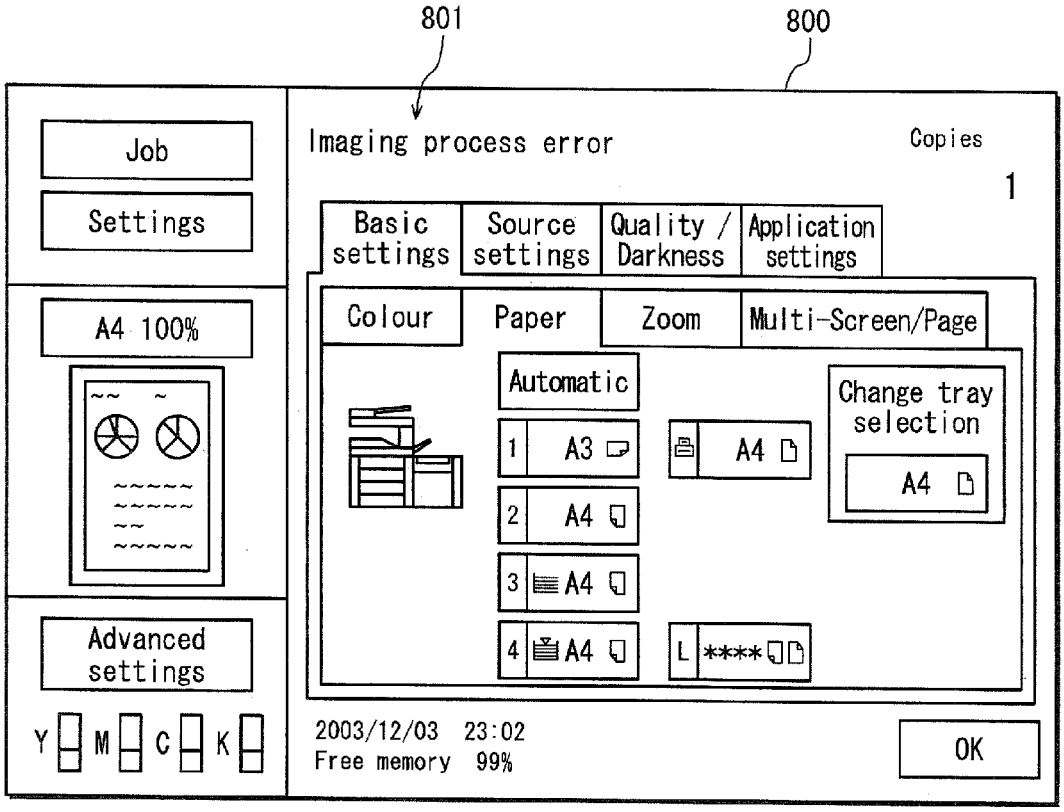
FIG. 8 illustrates an example of a user notification made when a 1 (detection) is registered in a determination result subfield as a result of abnormality detection.

FIG. 8 illustrates an example of a user notification made when a 1 (detection) is registered in the determination result subfield as a result of abnormality detection (corresponding to No in step S607 of FIG. 6). As shown, the operation panel includes a display screen 800 that displays a character string 801 reading "Imaging process error". Once this display is made, subsequent image formation operations are prohibited.

When a 2 (confirmation) is registered in the determination result subfield of the device memory 400 (corresponding to YES in step S607 of FIG. 6), the character string 801 is replaced with another character string reading "Imaging process error (Device)". When a 2 (confirmation) is registered in the determination result subfield of the IU memory 300, a character string reading "Imaging process error (IU)" is displayed. Accordingly, the user of the image formation device 1, or a service person, is able to determine whether the cause of a detected abnormality is more likely to be the image formation device 1 or the imaging unit 101.

[7] Variations

While the above explanation is given with respect to the preferred Embodiment, the present invention is, of course, not limited to the above-described Embodiment. The following variations are also possible.

(1) In the above-described Embodiment, the supply of toner is cited as an example of an imaging unit-related abnormality. However, the present invention is certainly not limited to this type of abnormality and may also detect other problems.

For example, a test area may be provided in the IU memory 300 so that data written thereto can be read out, thus enabling detection of access abnormalities in the IU memory 300. When detected, such an abnormality is likely due to damage to the IU memory, a faulty IU memory 300 electrical connection (faulty connection point), a power supply problem with the imaging unit 101, and so on.

(2) In the above-described Embodiment, the non-volatile memory 300 and 400 is described as able to register up to 32 types of abnormalities. However, the present invention is not limited as such. Many more types of abnormalities may also be registered. Alternatively, when fewer types of abnormalities are detectable, the non-volatile memory 300 and 400 may have fewer recording areas for the abnormality data. In addition, the above-described memory map is merely an example. A different memory map may also be used to achieve the structure of the present invention, provided that data corresponding to those described above can be registered therein. Further, the numerical values used to represent the detection results of no detection, detection, and confirmation may differ from those described above.

(3) Although not particularly mentioned in the above-described Embodiment, imaging unit 101 exchange may, for example, involve referencing the serial number of the imaging unit 101 when the doors of the image formation device 1 are opened and shut and making a comparison to a serial number referenced afterward. When the two serial numbers differ, the imaging unit 101 is deemed to have been exchanged. Needless to say, any other configuration may also be used for of the imaging unit 101 exchange detection to obtain the same effect.

(4) In the above-described Embodiment, the determination result in the abnormality data is updated when no further abnormalities are detected after the imaging unit 101 is exchanged. However, the present invention is not limited in this manner. The following variation is also possible. For instance, the determination result in the abnormality data may be updated when no abnormality is detected upon performing some form of abnormality detection process. Furthermore, the determination result in the abnormality data may be updated when no abnormality is detected immediately after the imaging unit 101 is exchanged. Alternatively, the determination result in the abnormality data may be updated only when the imaging unit 101 is exchanged for another imaging unit 101. The effect of the present invention is obtained regardless of the timing used for the aforementioned updates.

(5) In the above-described Embodiment, the image formation device is described as a colour printer. However, the present invention is not limited in this manner. The present invention is also applicable to a monochromatic printer. The present invention may further be applied to a copier, FAX machine, or multi-function peripheral (MFP). Abnormalities may also be detected pertaining to consumables other than imaging units. The present invention is applicable, with the same effects, to any image formation device in which potentially abnormal consumables are removable and exchangeable.

[8] Conclusion

The main function and effects of the present invention are summarized below. Naturally, no restrictions regarding the configuration and effects of the invention are intended.

In order to achieve this aim, an image formation device for use with a consumable removably loaded therein is provided, the consumable including a non-volatile consumable memory, the image formation device comprising: a non-volatile device memory; an abnormality detection unit detecting an abnormality pertaining to the consumable; a detection registration unit registering abnormality detection data into the consumable memory and into the device memory when the abnormality pertains to the consumable and no relevant abnormality data are registered in either of the consumable memory and the device memory, the abnormality detection data representing the detected abnormality; a confirmation registration unit registering abnormality confirmation data after the consumable has been exchanged and new abnormality detection data pertaining to a new abnormality detected by the abnormality detection unit are registered in only one of the consumable memory and the device memory, the abnormality confirmation data replacing the new abnormality detection data in the appropriate one of the consumable memory and the device memory; and a confirmation notification unit making a notification of abnormality confirmation when the abnormality confirmation data are registered by the confirmation registration unit.

When an abnormality is detected and a further abnormality is detected for the exchanged combination of image formation device and consumable, a strong possibility remains that the cause is either one of the exchanged consumable and the image formation device remaining constant before and after the consumable exchange. Accordingly, as described above, when a consumable-related abnormality is detected and nothing is registered in either of the consumable memory and the device memory, abnormality detection data are registered in both of the consumable memory and the device memory. Otherwise, abnormality confirmation data is registered in whichever memory has registered a previous abnormality. A notification is then provided to this effect, thereby assisting in determining the origin of the consumable-related damage.

Also, a registration update unit registers the abnormality detection data in the consumable memory and the device memory so as to replace the abnormality confirmation data when a predetermined time is reached without the abnormality indicated thereby being re-detected after the abnormality confirmation data have been registered. Alternatively, the registration update unit erases the abnormality detection data in the consumable memory and the device memory when a predetermined time is reached without the abnormality indicated thereby being re-detected after the abnormality detection data have been registered. Accordingly, once a transient abnormality has been detected, a new abnormality is prevented from being erroneously detected as the same abnormality.

In such a case, a history registration unit registers a count as history information, the count representing a number of times a predetermined abnormality detection process has been performed after the abnormality detection data registration without the abnormality indicated thereby being detected, wherein the predetermined time corresponds to a time at which the count registered as the history information reaches a predetermined value. Furthermore, the predetermined abnormality detection process is any instance of the abnormality detection process. Also, the predetermined abnormality detection process may be any instance of the abnormality detection process performed immediately after the consumable is loaded, or an identification unit may distinctly identify each consumable, such that the predetermined abnormality detection process is any instance of the abnormality detection process performed immediately after another consumable is loaded.

In addition, the abnormality detection data and the abnormality confirmation data registered in the device memory each include identification data pertaining to a relevant consumable. Further, the abnormality detection data and the abnormality confirmation data registered in the consumable memory each include identification data pertaining to a relevant device. This makes for a more convenient investigation of the combination of device and consumable when an abnormality is detected therein.

Additionally, a detection notification unit making an abnormality detection notification when the abnormality is detected and no abnormality detection data are registered in either of the consumable memory and the device memory. Given that a service person is called upon notification being made, this suggests the cause of the damage.

Although the present invention has been fully described by way of examples with reference to the accompanying drawings, various changes and modifications thereto will be apparent to those skilled in the art.

Therefore, unless stated that such changes and modifications depart from the scope of the present invention, all such should be construed as being included therein.

What is claimed is:

1. An image formation device for use with a consumable removably loaded therein, the consumable including a non-volatile consumable memory, the image formation device comprising:

a non-volatile device memory;

an abnormality detection unit detecting an abnormality pertaining to the consumable;

a detection registration unit registering abnormality detection data into the consumable memory and into the device memory when the abnormality pertains to the consumable and no relevant abnormality data are registered in either of the consumable memory and the device memory, the abnormality detection data representing the detected abnormality;

a confirmation registration unit registering abnormality confirmation data after the consumable has been exchanged and new abnormality detection data pertaining to a new abnormality detected by the abnormality detection unit are registered in only one of the consumable memory and the device memory, the abnormality confirmation data replacing the new abnormality detection data in the appropriate one of the consumable memory and the device memory; and a confirmation notification unit making a notification of abnormality confirmation when the abnormality confirmation data are registered by the confirmation registration unit.

2. The image formation device of claim 1, further comprising a registration update unit registering the abnormality detection data in the consumable memory and the device memory so as to replace the abnormality confirmation data when a predetermined time is reached without the abnormality indicated thereby being re-detected after the abnormality confirmation data have been registered.

3. The image formation device of claim 1, further comprising a registration update unit erasing the abnormality detection data in the consumable memory and the device memory when a predetermined time is reached without the abnormality indicated thereby being re-detected after the abnormality detection data have been registered.

4. The image formation device of claim 2, further comprising a history registration unit registering a count as history information, the count representing a number of times a predetermined abnormality detection process has been performed after the abnormality detection data registration without the abnormality indicated thereby being detected, wherein the predetermined time corresponds to a time at which the count registered as the history information reaches a predetermined value.

5. The image formation device of claim 4, wherein the predetermined abnormality detection process is any instance of the abnormality detection process.

6. The image formation device of claim 4, wherein the predetermined abnormality detection process is any instance of the abnormality detection process performed immediately after the consumable is loaded.

7. The image formation device of claim 4, further comprising an identification unit distinctly identifying each consumable, wherein the predetermined abnormality detection process is any instance of the abnormality detection process performed immediately after another consumable is loaded.

8. The image formation device of claim 1, wherein the abnormality detection data and the abnormality confirmation data registered in the device memory each include identification data pertaining to a relevant consumable.

9. The image formation device of claim 1, wherein the abnormality detection data and the abnormality confirmation data registered in the consumable memory each include identification data pertaining to a relevant device.

10. The image formation device of claim 1, further comprising a detection notification unit making an abnormality detection notification when the abnormality is detected and no abnormality detection data are registered in either of the consumable memory and the device memory.

* * * * *